US007397186B2

(12) United States Patent
Kwon et al.

(10) Patent No.: US 7,397,186 B2
(45) Date of Patent: Jul. 8, 2008

(54) PLASMA DISPLAY PANEL

(75) Inventors: Jae-Ik Kwon, Suwon-si (KR); Sung-Ho Song, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 484 days.

(21) Appl. No.: 10/925,201

(22) Filed: Aug. 23, 2004

(65) Prior Publication Data

US 2005/0082977 A1 Apr. 21, 2005

(30) Foreign Application Priority Data

Oct. 16, 2003 (KR) ..... 10-2003-0072362

(51) Int. Cl.
*H01R 12/36* (2006.01)

(52) U.S. Cl. ..... 313/583; 345/206

(58) Field of Classification Search ..... 345/205, 345/206, 41, 42; 313/582–587; 174/17.08, 174/50.52, 50.6, 250–268; 315/169.4
See application file for complete search history.

(56) References Cited

U.S. PATENT DOCUMENTS 4,320,438 A * 3/1982 Ibrahim et al. ..... 361/764
4,550,039 A * 10/1985 Glaser et al. ..... 428/13
4,598,960 A * 7/1986 DiSanto et al. ..... 439/66
4,684,974 A * 8/1987 Matsunaga et al. ..... 345/205
4,772,820 A * 9/1988 DiSanto et al. ..... 313/505
5,754,171 A * 5/1998 Stoller ..... 345/205
5,757,450 A * 5/1998 Fujii et al. ..... 349/106
6,738,032 B1 * 5/2004 Park ..... 345/60

FOREIGN PATENT DOCUMENTS

JP 2001-283736 10/2001
KR 2002-0023155 3/2002

OTHER PUBLICATIONS

Korean Patent Abstracts for Publication No. 1020020023155 A; Date of publication of application Mar. 28, 2002, in the name of Yamaguchi Yoshio.
Patent Abstracts of Japan, Publication No. 2001-283736; Date of Publication Oct. 12, 2001; in the name of Yoshimi Shirakawa, et al.

* cited by examiner

*Primary Examiner*—Nimeshkumar Patel
*Assistant Examiner*—Christopher Raabe
(74) *Attorney, Agent, or Firm*—Christie, Parker & Hale, LLP

(57) ABSTRACT

A plasma display panel includes first and second substrates provided opposing one another with a predetermined gap therebetween. Address electrodes are formed on the first substrate. Barrier ribs defining discharge cells are mounted in a display region between the substrates. Further, discharge sustain electrodes are formed on the second substrate substantially perpendicular to the address electrodes. The electrodes are formed into groups of a predetermined number, and the electrodes include effective segments positioned in the display region, terminal segments positioned in a terminal region outside the display region and having a smaller pitch than that of the effective segments, and intermediate segments interconnecting these segments. In at least one group, lengths of elements of the terminal segments increasingly decrease as a distance from a center of the group is increased.

20 Claims, 7 Drawing Sheets

PLASMA DISPLAY PANEL

CROSS-REFERENCE TO RELATED APPLICATIONS

This application claims priority to and the benefit of Korean Patent Application No. 10-2003-0072362 filed on Oct. 16, 2003 in the Korean Intellectual Property Office, the entire content of which is incorporated herein by reference.

BACKGROUND OF THE INVENTION (a) Field of the Invention

The present invention relates to a plasma display panel (PDP), and more particularly, to a terminal area structure of electrodes in a PDP.

(b) Description of the Related Art

A PDP is a display device that uses vacuum ultraviolet rays generated by gas discharge in discharge cells to excite phosphors, thereby realizing the display of images. With its ability to realize high-resolution images, the PDP is emerging as one of the most popular flat panel display configurations used for wall-mounted televisions and other similar large-screen applications. The different types of PDPs include the AC-PDP, DC-PDP, and hybrid PDP. The AC-PDP, utilizing a triode surface discharge structure, is becoming the most common configuration.

In the AC-PDP with a triode surface discharge structure, address electrodes, barrier ribs, and phosphor layers are formed on a rear substrate corresponding to each discharge cell. Sustain electrodes comprised of scanning electrodes and common electrodes are formed on a front substrate. A dielectric layer is formed covering the address electrodes on the rear substrate, and another dielectric layer is formed covering the sustain electrodes on the front substrate. In addition, discharge gas (typically an Ne—Xe compound gas) is filled in the discharge cells.

Using the above structure, an address voltage Va is applied between an address electrode and a scanning electrode to select a discharge cell. If a sustain voltage Vs is applied between the common electrode and the scanning electrode of the selected discharge cell, plasma discharge occurs in the discharge cell. Vacuum ultraviolet rays are emitted from the excited Xe atoms created during plasma discharge. The vacuum ultraviolet rays excite phosphors so that they glow (i.e., emit visible light) and thereby enable the display of predetermined images.

FIG. 10 is a partial enlarged plan view of a conventional PDP, and FIG. 11 is a partial enlarged plan view of electrodes shown in FIG. 10.

With reference to FIG. 10, the PDP structured and operating as described above includes substrates having display region 1 where images are generated, and terminal region 3 formed outside display region 1. One end of electrodes 2 is extended into terminal region 3 for connection to connecting member 5 such as a flexible printed circuit (FPC) or a chip-on-film (COF). Electrodes 2 receive voltages from a drive circuit board (not shown) via connecting member 5. The voltages are used to drive the PDP.

Electrodes 2 have a pitch in display region 1 of the substrate that is different from a pitch in terminal region 3. In particular, electrodes 2 have pitch P1 in effective segments 7 thereof positioned in display region 1, and pitch P2 in terminal segments 9 thereof positioned in terminal region 3. Pitch P2 is smaller than pitch P1. Electrodes 2 make this transition from larger pitch P1 to smaller pitch P2 through intermediate segments 11 thereof. That is, if electrodes 2 are grouped together by a predetermined number of the same (one such group is shown in FIG. 10), intermediate segments 11 of electrodes 2 to the outside of a set number of electrodes 2 positioned in the center of the particular group and which progress linearly to terminal segments 9 are slanted inwardly at predetermined angles toward intermediate segments 11 of these center electrodes 2.

Pitch P2 of terminal segments 9 of electrodes 2 is made small for the following two reasons. First, it is necessary to form an align mark (not shown) in terminal region 3 for better connection of connecting member 5, and space (obtained by smaller pitch P2) is required for the align mark. Further, with use of a plurality of connecting members 5, it is necessary that there be sufficient room between adjacent connecting members 5 to prevent electrical interference between the same.

In the PDP with the above electrode structure, with reference to FIG. 11, if display region 1 is enlarged in an attempt to make better use of the substrates, or if the number of electrodes is increased to realize better picture quality, pitch P3 in intermediate segments 11 is made even smaller at outer electrodes of each grouping of electrodes than pitch P3' at center areas thereof.

Therefore, when manufacturing the PDP (i.e., during exposure and developing processes for the electrodes), because a distance between intermediate segments 11 or terminal segments 9 is very narrow, it becomes increasingly difficult to design a pattern of terminal segments 9 and of intermediate segments 11 of electrodes 2 that does not have serious flaws. In addition, short circuits may occur in electrodes 2 because of poor shapes of manufactured segments 9, 11.

Hence, the conventional structure places limitations on the degree to which the display region may be increased relative to the terminal region. Stated differently, there are limits to any attempts at making more effective use of the substrate. Furthermore, there are also restrictions with respect to increasing the number of electrodes in an effort to improve picture quality.

SUMMARY OF THE INVENTION

In one exemplary embodiment of the present invention, there is provided a plasma display panel structured such that short circuits do not occur between electrodes in terminal regions, even when a display region is enlarged or the number of electrodes is increased.

In an exemplary embodiment of the present invention, a plasma display panel includes a first substrate and a second substrate provided opposing one another with a predetermined gap therebetween. Address electrodes are formed on a surface of the first substrate opposing the second substrate. Barrier ribs are mounted in a display region established in the first and second substrates, the barrier ribs defining discharge cells. Discharge sustain electrodes are formed on a surface of the second substrate opposing the first substrate, the discharge sustain electrodes being formed substantially perpendicular to the address electrodes. The electrodes are formed into units of groups of a predetermined number of the electrodes. The electrodes include effective segments positioned in the display region. Terminal segments are positioned in a terminal region located outside the display region, and have a pitch that is smaller than a pitch of the effective segments. Intermediate segments interconnect the effective segments and the terminal segments.

At least one group may be configured such that lengths of elements of the terminal segments increasingly decrease as a distance from a center of the at least one group is increased.

The elements of the terminal segments may be selectively reduced in length.

Further, elements of the intermediate segments may be curved in a direction away from the center of the corresponding group. In this case, the elements of the intermediate segments may have an increasingly decreasing curvature as a distance to the center of the corresponding group is reduced.

The intermediate segments include elements mounted in the terminal region, and at least one of these elements of each electrode group may have a bend in the terminal region.

Each of the elements may have at least two linear sections, and the bend of the elements is arc-shaped.

An angle of 90 degrees or greater may be formed between the linear sections.

The intermediate segments may include first linear sections formed connected to the effective segments without undergoing any additional bending and change in curvature, and second linear sections extended from the bends to be connected to the terminal segments without undergoing any additional bending and change in curvature, the first and second linear sections having a length that decreases as the centers of the electrode groups are approached.

In another embodiment, the intermediate segments may include first, second, and third linear sections interconnected at obtuse angles formed therebetween such that the first linear section interconnects the third linear section, the second linear section interconnects the third linear section, and the bend of the elements is arc-shaped.

The first linear sections may be formed connected to the effective segments without undergoing any additional bending and change in curvature. The third linear sections may be extended at a predetermined angle to the first linear sections. The second linear sections may be extended at a predetermined angle to the third linear sections. The first linear sections, the second linear sections, and the third linear sections may have a length that decreases as the centers of the electrode groups are approached.

In each of the electrode groups, a straight line or a curved line may be drawn through points where the intermediate segments meet the terminal segments.

In another embodiment an interconnection circuit for interconnecting electrodes to input terminals is provided. A group of first segments interface with respective electrodes, the group of first segments having an output pitch between each of the first segments. A group of second segments interface with respective input terminals, the group of second segments having an input pitch between each of the second segments, the input pitch being smaller than the output pitch. Lengths of the second segments increasingly decrease as a distance from a center of the group of second segments is increased. The second segments may be selectively reduced in length. The first segments may be curved in a direction away from the center. The first segments may have an increasingly decreasing curvature as a distance to the center is reduced. The first segments may each have at least two linear sections. An angle of 90 degrees or greater may be formed between the at least two linear sections.

DETAILED DESCRIPTION

Figure 3:
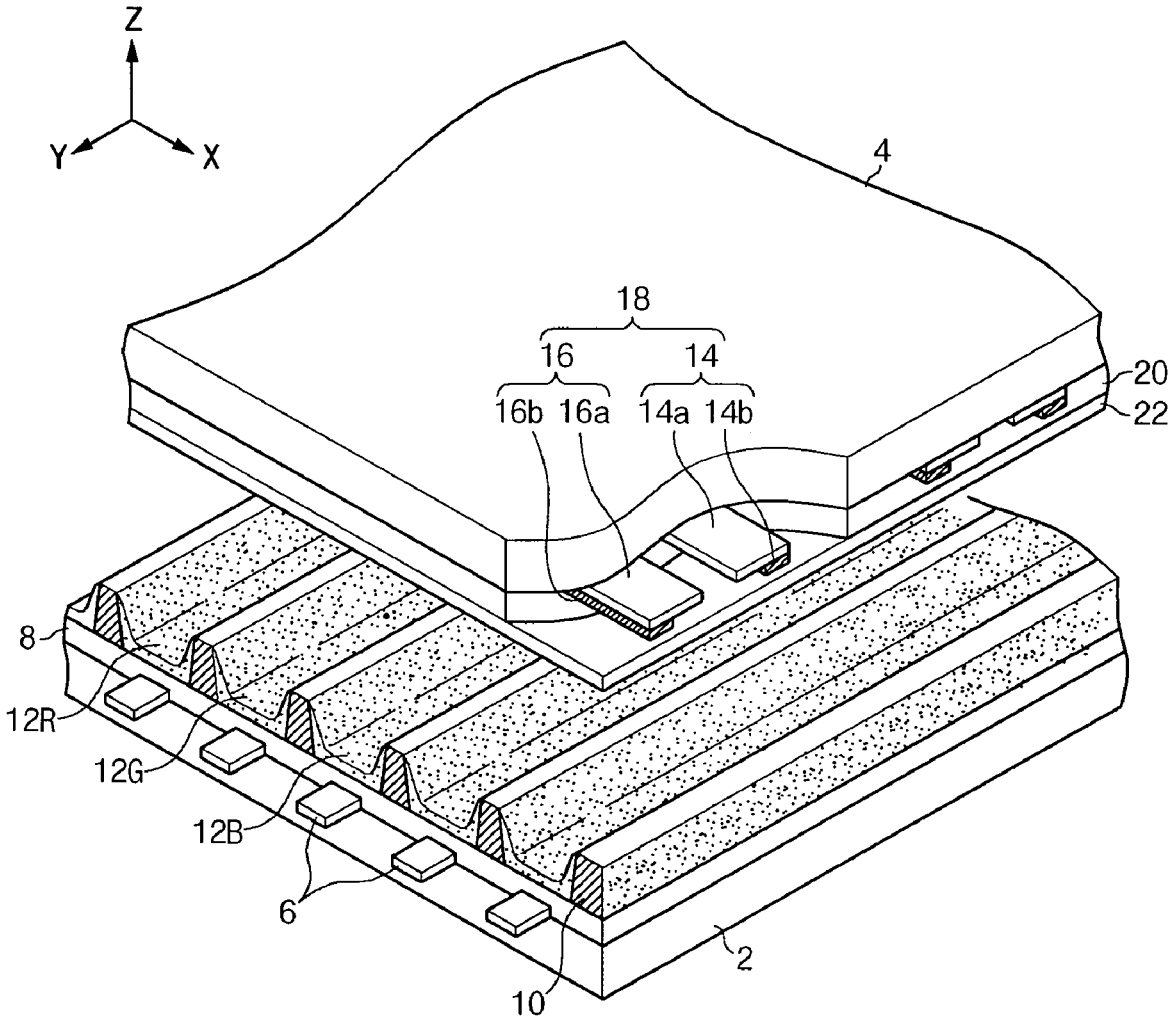
FIG. 3 is a partial exploded perspective view of a plasma display panel according to an exemplary embodiment of the present invention.

Referring first to FIG. 3, a PDP according to an exemplary embodiment of the present invention includes first substrate 2 and second substrate 4 provided opposing one another with a predetermined gap therebetween. Discharge cells are formed in the gap between first substrate 2 and second substrate 4. An independent discharge mechanism of each of the discharge cells functions to emit visible light to thereby realize the display of predetermined color images.

In more detail, address electrodes 6 are formed on a surface of first substrate 2 opposing second substrate 4. Address electrodes 6 are formed along one direction (e.g., direction Y). In one embodiment, address electrodes 6 are formed in a striped pattern with predetermined spacing between adjacent address electrodes 6. First dielectric layer 8 is formed over an entire inner surface of first substrate 2 covering address electrodes 6.

Barrier ribs 10 are formed on first dielectric layer 8. In one embodiment, barrier ribs 10 are formed in a striped pattern having long axes that are substantially parallel to the long axes of address electrodes 6. Red, green, and blue phosphor layers 12R, 12G, 12B are formed along the walls of barrier ribs 10 opposing one another, and on exposed areas of first dielectric layer 10 between barrier ribs 10. One of the red, green, and blue phosphor layers 12R, 12G, 12B is formed between each pair of barrier ribs 10. Further, red, green, and blue phosphor layers 12R, 12G, 12B are formed repeatedly in this sequence over the entire first substrate 2. Barrier ribs 10 are not limited to a striped pattern, and it is possible to use a closed lattice configuration and other various structures.

Formed on a surface of second substrate 4 facing first substrate 2 and along a direction substantially perpendicular to address electrodes 6 (e.g., direction X) are sustain electrodes 18. Sustain electrodes 18 are comprised of scan electrodes 14 and common electrodes 16. Transparent second dielectric layer 20 is formed over an entire surface of second substrate 4 covering sustain electrodes 18, and MgO protection layer 22 is formed covering second dielectric layer 20.

Scan electrodes 14 are comprised of transparent electrodes 14*a* formed in a striped pattern, and bus electrodes 14*b* formed along one lengthwise edge of each of the transparent electrodes 14*a*. Similarly, common electrodes 16 are comprised of transparent electrodes 16*a* formed in a striped pattern, and bus electrodes 16*b* formed along one lengthwise edge of each of the transparent electrodes 16*a*. In one embodiment, transparent electrodes 14*a*, 16*a* are made of a transparent material such as indium tin oxide (ITO), and bus electrodes 14*b*, 16*b* are made of a metal containing silver, aluminum, or copper.

First and second substrates 2, 4 structured as in the above are joined together. As a result, discharge cells are formed by discharge regions defined by areas where address electrodes 6 intersect sustain electrodes 18. A discharge gas (typically an Ne—Xe compound gas) is filled in the discharge cells, thereby completing the PDP.

In the PDP configured as described above, an address voltage Va is applied between address electrode 6 and scan electrodes 14 such that discharge cells in which illumination is to occur through address discharge are selected. Next, a sustain voltage Vs is applied between scan electrodes 14 and common electrodes 16 of the selected discharge cells. As a result, plasma discharge occurs in the discharge cells, and vacuum ultraviolet rays are emitted from the excited Xe atoms created during plasma discharge. The vacuum ultraviolet rays excite phosphor layers 12R, 12G, 12B so that they emit visible light. Predetermined images are realized by performing this operation in a selective manner over the entire PDP.

Figure 1:
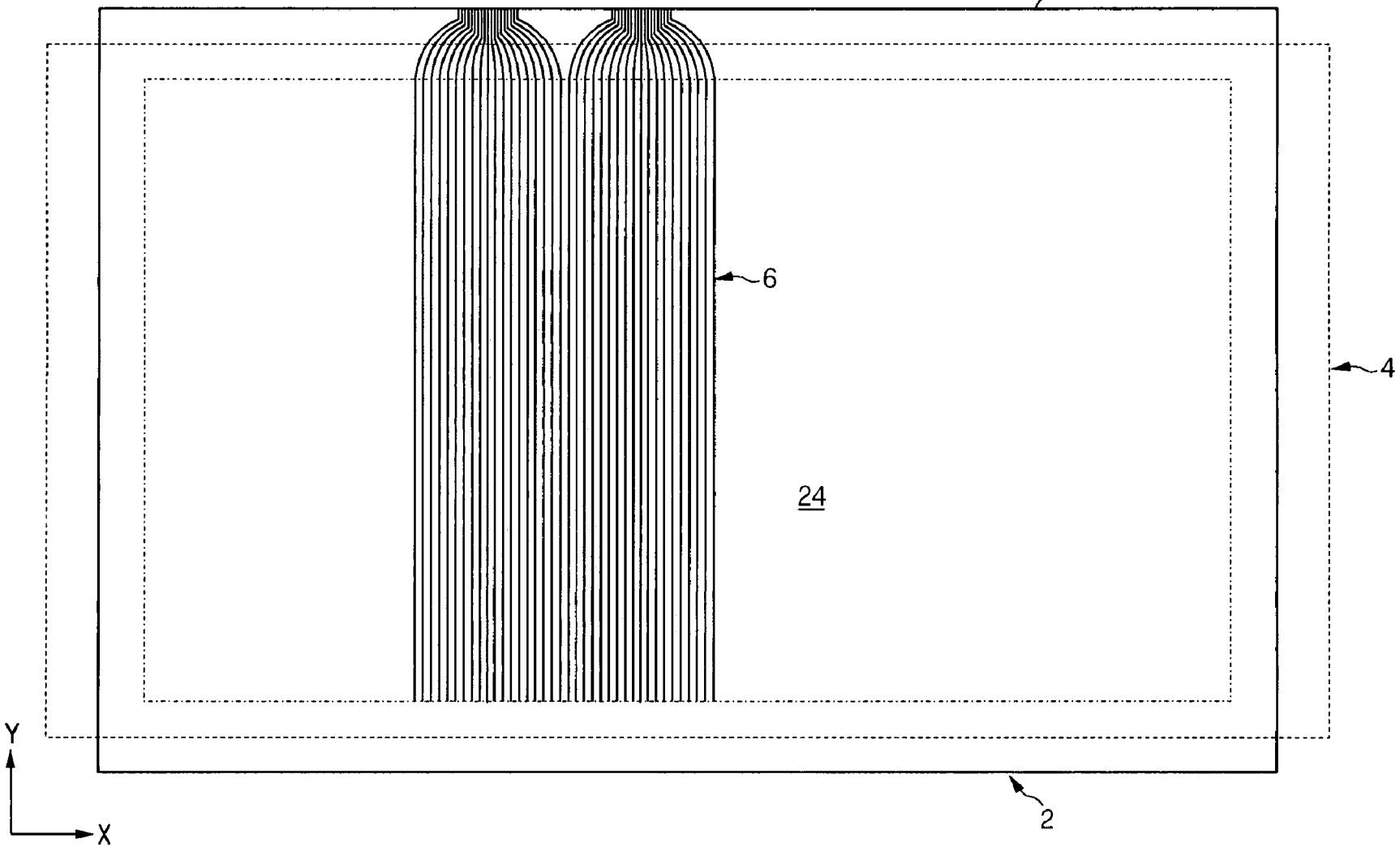
FIG. 1 is a schematic plan view of a plasma display panel used to describe a structure of electrodes formed on a first substrate according to an exemplary embodiment of the present invention.
Figure 2:
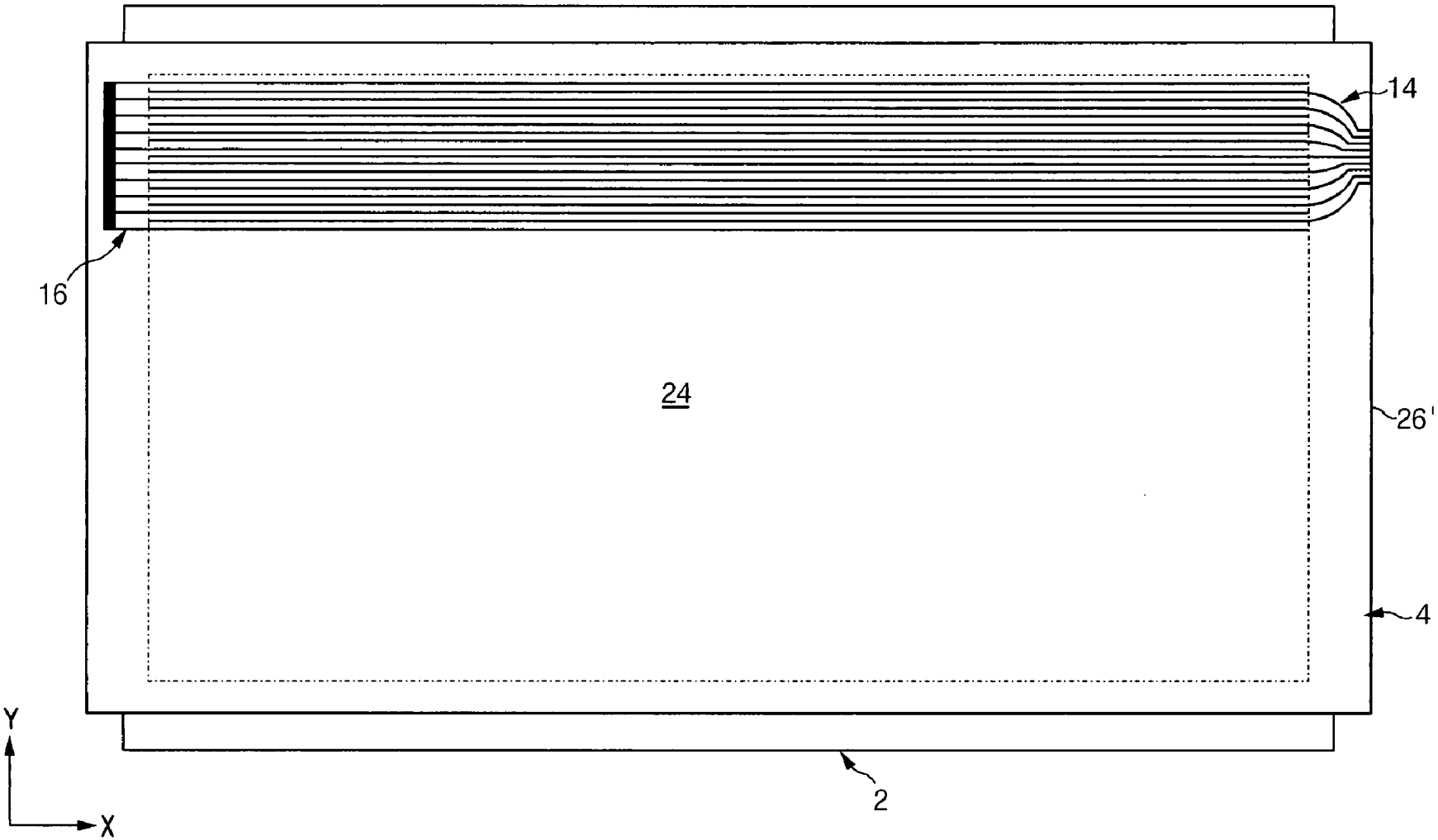
FIG. 2 is a schematic plan view of a plasma display panel used to describe a structure of electrodes formed on a second substrate according to an exemplary embodiment of the present invention.

The electrodes that effect plasma discharge in the discharge cells, with reference to FIGS. 1 and 2, are extended over display region 24 where the discharge cells are located and where display takes place, and also extend into terminal regions 26, 26' located outside display region 24. The electrodes are connected to connecting members (not shown) in terminal regions 26, 26' to receive voltages required for driving the PDP.

In the PDP of the exemplary embodiment of the present invention, an electrode structure in terminal regions 26, 26' is improved such that a short circuit does not occur between electrodes, even when display region 24 is enlarged or when the number of electrodes is increased to enhance picture quality. Also, the electrode structure is such that stability in the manufacturing processes is ensured. This structure is particularly effective when used for address electrodes 6 and scan electrodes 14. In the following, an example of an electrode structure in terminal region 26 as it applies to address electrodes 6 will be described.

Figure 4:
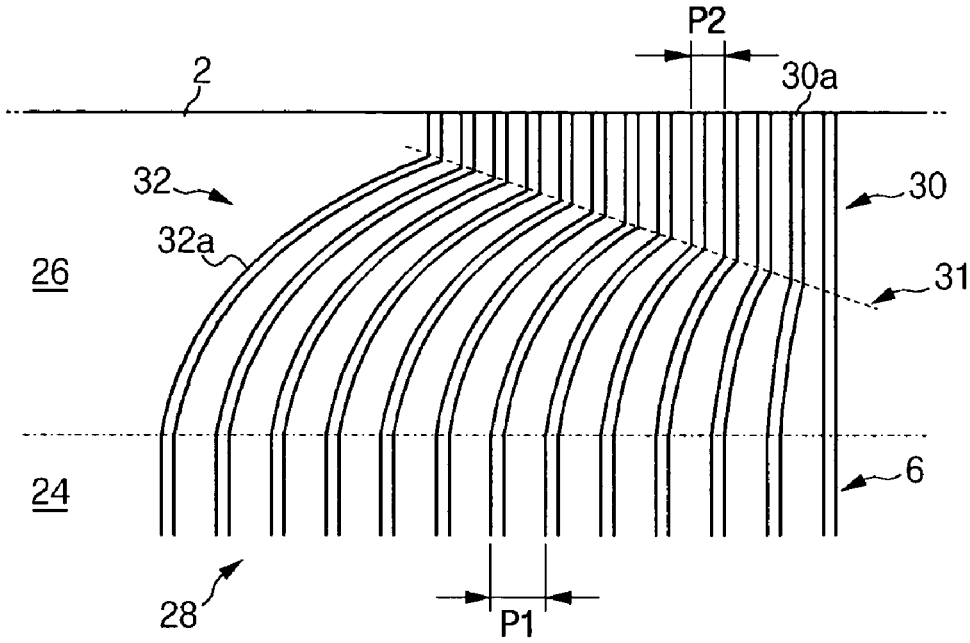
FIG. 4 is a partial enlarged plan view of a specific area of a plasma display panel according to an exemplary embodiment of the present invention.

FIG. 4 is a partial enlarged plan view of a specific area of a plasma display panel according to an exemplary embodiment of the present invention. Address electrodes 6 are divided into electrode groups of a predetermined number of address electrodes 6. One-half of one such electrode group of address electrodes 6 is shown in FIG. 4. Address electrodes 6 include effective segments 28 positioned in display region 24, terminal segments 30 positioned to the furthermost outside area of terminal region 26 (i.e., furthermost from display region 24), and intermediate segments 32 interconnecting effective segments 28 and terminal segments 30. Effective segments 28 have pitch P1, and terminal segments 30 have pitch P2 that is smaller than pitch P1 of effective segments 28.

Elements 30*a* of terminal segments 30 have a length that is greatest at a center of the electrode groups, and that gradually decreases as a distance from the center of the electrode groups is increased. Such a formation of terminal segments 30 enables a sufficient space to be formed between intermediate segments 32 having elements 32*a* at outer areas of the electrode groups to thereby prevent a short circuit from occurring between intermediate segments 32. If terminal segments 30 of address electrodes 6 are formed with the varying lengths as described above, straight line 31 may be drawn through points where elements 32*a* of intermediate segments 32 meet elements 30*a* of terminal segments 30.

Figure 5:
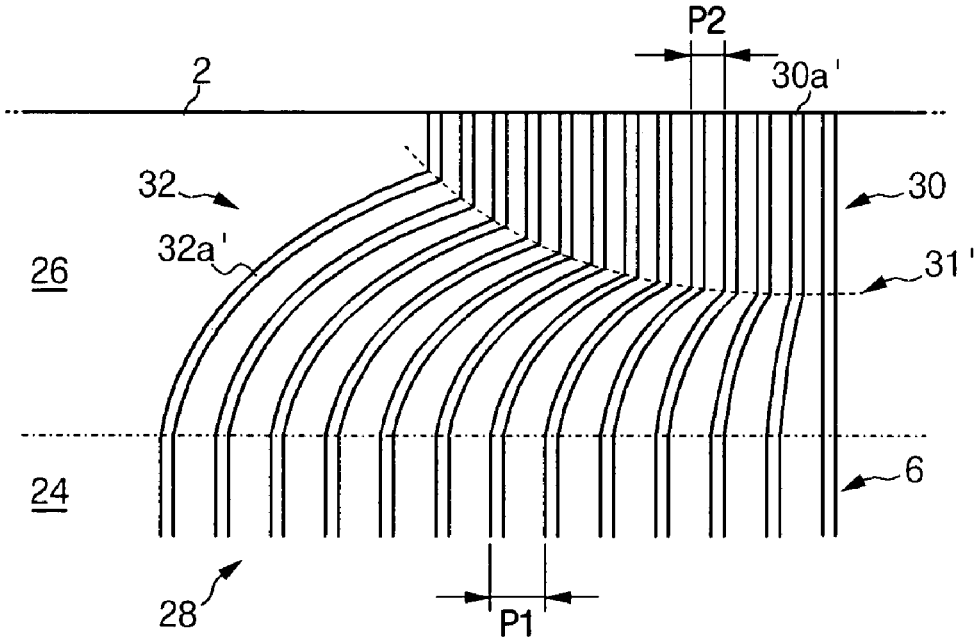
FIGS. 5-9 are partial enlarged plan views of specific areas of plasma display panels according to additional exemplary embodiments of the present invention.

In another embodiment, with reference to FIG. 5, terminal segments 30 of address electrodes 6 (of each half of each electrode group) having elements 30*a'* are varied in length such that curved line 31' may be drawn through points where elements 32*a'* of intermediate segments 32 meet elements 30*a'* of terminal segments 30. In this case, the curved line has a gradually decreasing curvature ratio as the center of the particular electrode group is approached.

Further, in the embodiments shown in FIGS. 4 and 5, elements 32*a* of intermediate segments 32 are increasingly curved (i.e., have an increasing curvature ratio) in a direction away from the center of the electrode groups as a distance from the same is increased. Intermediate segments 32 are structured in this manner so that distances therebetween at outer areas of the electrode groups are increased.

With the formation of terminal segments 30 and intermediate segments 32 as described above, a sufficient space may be provided between address electrodes 6 in the outer areas of electrode groups so that short circuits do not occur between address electrodes 6. This is the case even when display region 24 is enlarged, or when the number of address electrodes 6 is increased. The same configuration may be used for other electrodes of the PDP such as scan electrodes 14 to obtain similar results. Hence, manufacturing processes are stabilized, more of substrates 2 and 4 may be used to display images (by enlarging display region 24), and better picture quality may be obtained (by increasing the number of electrodes).

Additional exemplary embodiments of the present invention will be described with reference to FIGS. 6-9. As in the above embodiments, the configuration of address electrodes 6 will be described with the understanding that the same structure may be applied to other electrodes of the PDP.

Figure 6:
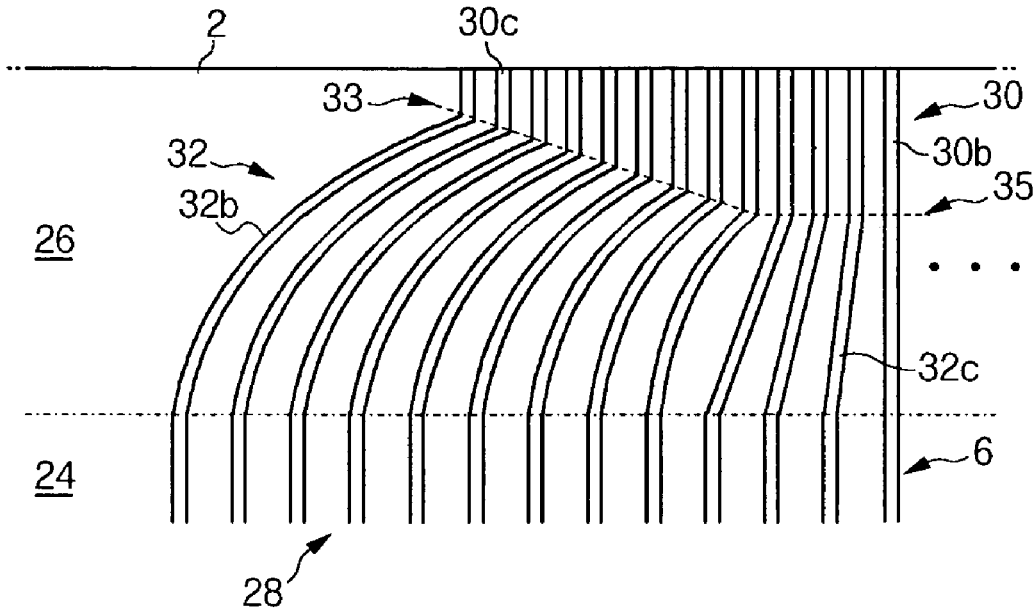

In yet another exemplary embodiment of the present invention, with reference to FIG. 6, elements 30*b* of terminal segments 30 of address electrodes 6 located at the centers of the electrode groups have substantially the same length. However, elements 30*c* of terminal segments 30 of address electrodes 6 located in outer areas of the electrode groups have a length that increasingly decreases as the distance to the centers of the electrode groups is increased.

In addition, elements 32*b* of intermediate segments 32 of address electrodes 6 in the outer areas of the electrode groups are formed with an increasing curvature ratio as the distance to the centers of the electrode groups is increased. Elements 32*c* of intermediate segments 30 of address electrodes 6, on the other hand, are linearly formed for connection to effective segments 28 on one end and to terminal segments 30 on the other end. As a result, one straight line 33 may be drawn along points where elements 32*b* of intermediate segments 32 meet elements 30*c* of terminal segments 30, and another straight line 35 may be drawn along points where elements 32*c* of intermediate segments 30 meet elements 30*b* of terminal segments 30.

Figure 7:
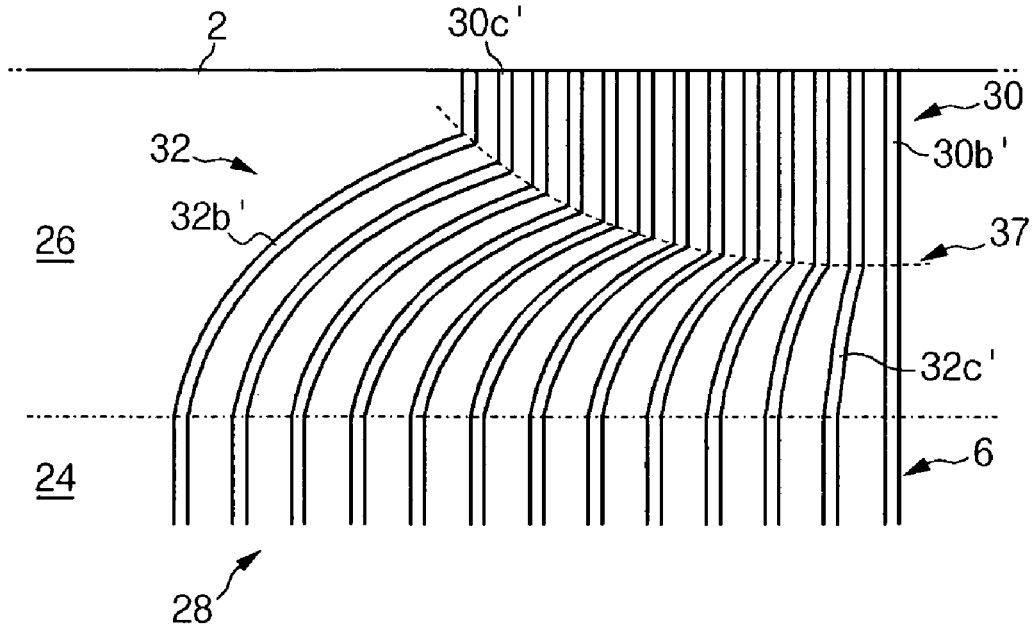

With reference to FIG. 7, in still yet another exemplary embodiment of the present invention and using the basic configuration of the exemplary embodiment of FIG. 6, elements 32*b'*, 32*c'* of intermediate segments 32, and elements 30*c'*, 30*b'* of terminal segments 30 are configured such that curved line 37 may be drawn where elements 32*b'*, 32*c'* of intermediate segments 32 meet elements 30*b'*, 30*c'* of terminal segments 30. In this case, elements 32*c'* of intermediate segments 32 are not all formed linearly and start to curve almost immediately, and elements 30*b'* of terminal segments 30 may be slightly lengthened to allow for such a curved line to be drawn as described above.

Figure 8:
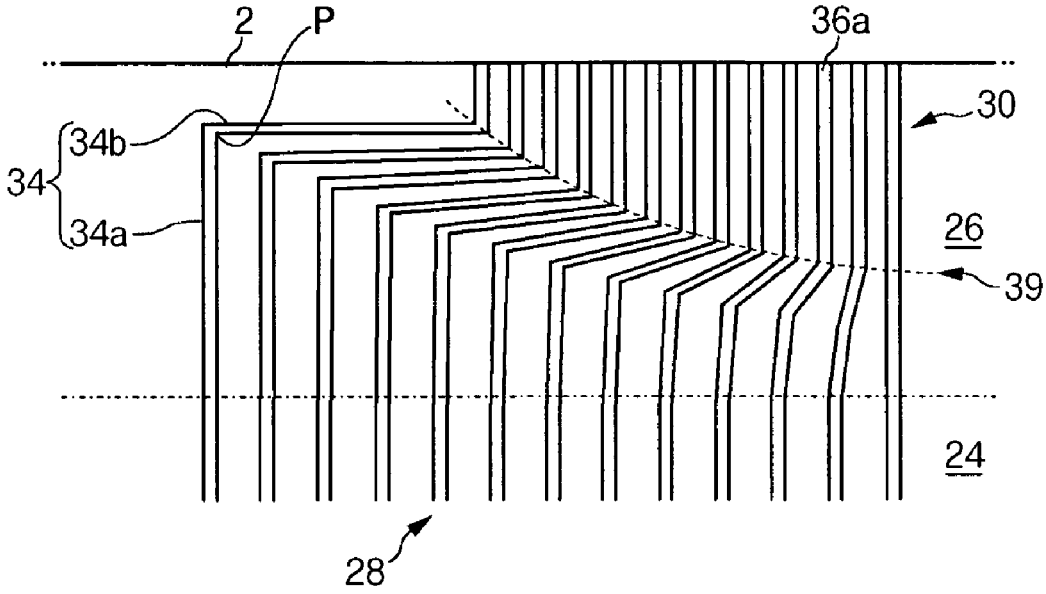

In still yet another exemplary embodiment of the present invention, with reference to FIG. 8, intermediate segments 34 are formed in terminal region 26 as two linear sections, i.e., first linear sections 34*a* and second linear sections 34*b*, with bend P provided at a predetermined angle therebetween. In one embodiment, the predetermined angle of bends P is 90 degrees or greater.

In the exemplary embodiment of FIG. 8, first linear sections 34*a* are formed connected to effective segments 28 without undergoing any additional bending or change in curvature. Second linear sections 34*b* are extended from bends P to be connected to terminal segments 30 without undergoing any additional bending or change in curvature. First linear sections 34*a* have a maximum length starting from furthermost outer address electrode 6, and gradually decrease in length as the centers of the electrode groups are approached.

Furthermore, second linear sections 34*b* of intermediate segments 34 and terminal segments 30 are formed to lengths corresponding to this formation of first linear sections 34*b*. That is, second linear segments 34*b* have a length that decreases as the centers of the groups are approached, while terminal segments 30 have a length that gradually increases as the centers of the groups are approached. The end result is that arc-shaped line 39 may be drawn along points where second linear segments 34*b* of intermediate segments 34 meet terminal segments 30.

Figure 9:
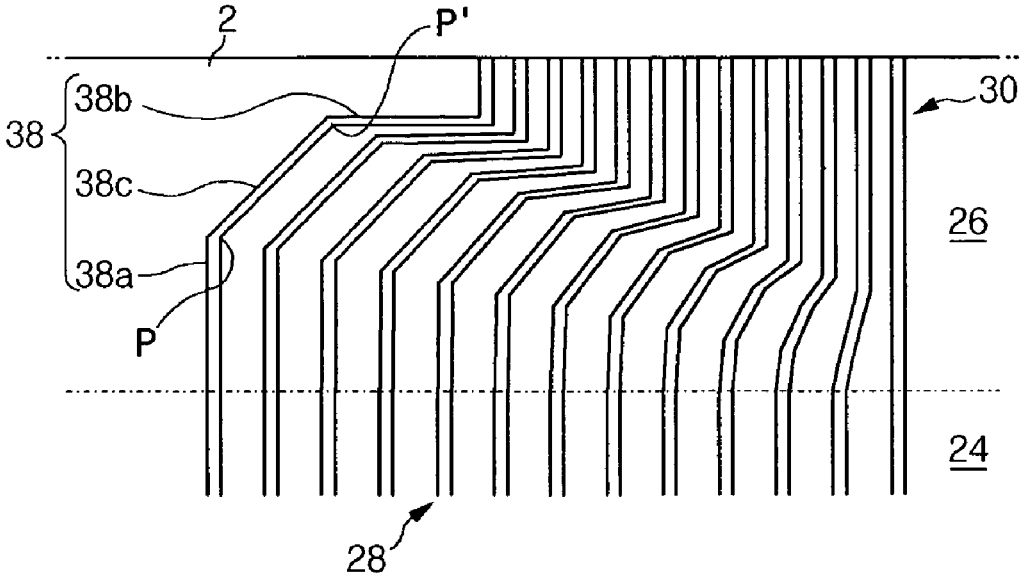
Figure 10:
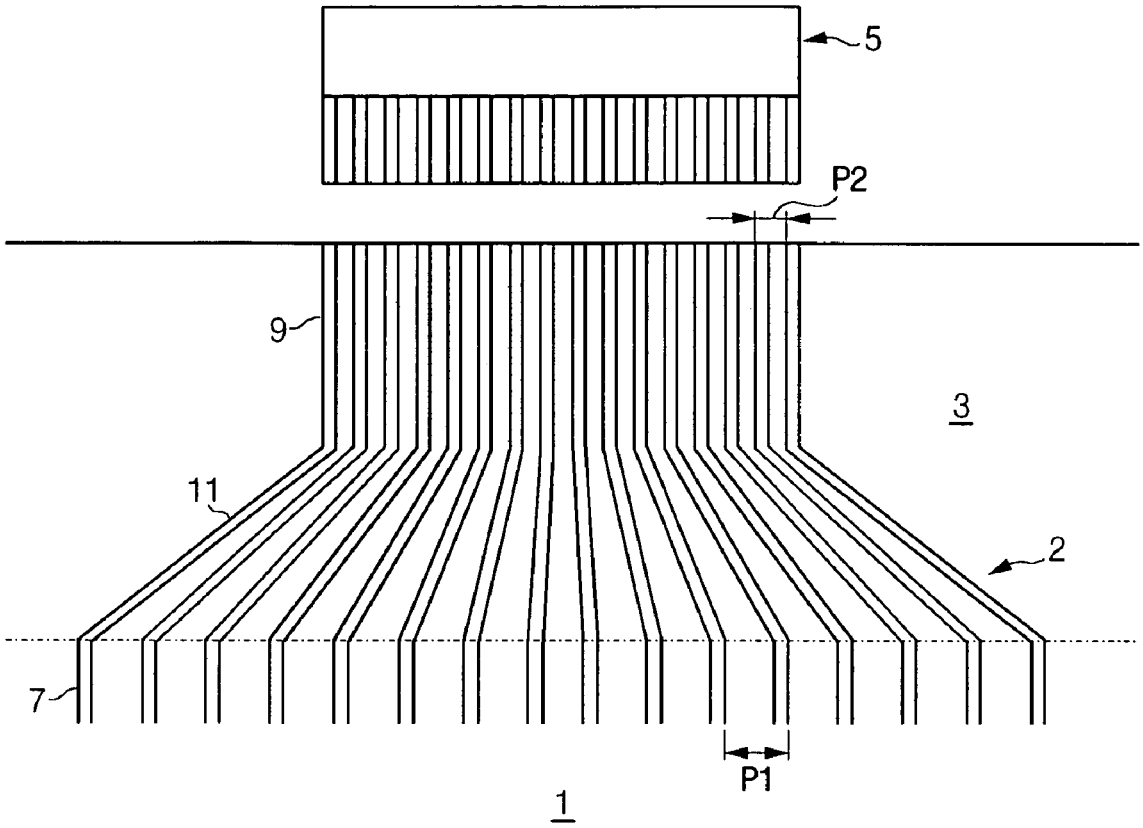
Fig. 10 (Prior Art)
FIG. 10 is a partial enlarged plan view of conventional plasma display panel.
Figure 11:
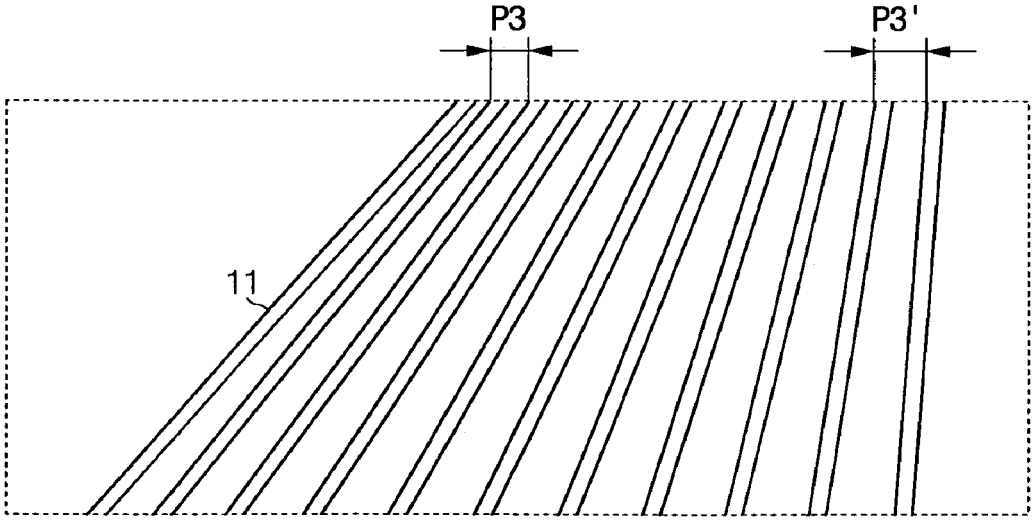
Fig. 11 (Prior Art)
FIG. 11 is a partial enlarged plan view of electrodes shown in FIG. 10.

Still yet another exemplary embodiment of the present invention is shown in FIG. 9. In this exemplary embodiment, intermediate segments 38 are formed with three linear sections, i.e., first linear sections 38*a*, second linear sections 38*b* and third linear section 38*c*, bend P formed between first linear sections 38*a* and third linear sections 38*c* and bend P' formed between second linear sections 38*b* and third linear sections 38*c*.

In more detail, first linear sections 38*a* are formed connected to effective segments 28 without undergoing any additional bending or change in curvature. Third linear sections 38*c* are extended at a predetermined angle to first linear sections 38*a* realized at bend P, and second linear sections 38*b* are extended at a predetermined angle to third linear sections 38*c* realized at bend P'. First linear sections 38*a*, second linear sections 38*b*, and third linear sections 38*c* all have a length that decreases as the centers of the electrode groups are approached.

In the exemplary embodiments of FIGS. 8 and 9, a pattern inspection to determine if there are any defects following electrode formation may be more easily performed. These exemplary embodiments also allow for the more effective use of terminal region 26.

In the present invention structured as described above, a sufficient space may be provided between the electrodes in the outer areas of the electrode groups. Such an advantage may be obtained even when the display region is enlarged to make more effective use of the substrates, or when the number of the electrodes is increased to enhance picture quality. Therefore, short circuits between electrodes are prevented during electrode manufacture to thereby stabilize manufacture, and increasing the display region or the number of electrodes to obtain the attendant advantages is made possible.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing one another with a gap therebetween;

address electrodes on a surface of the first substrate opposing the second substrate;

barrier ribs in a display region between the first substrate and the second substrate, the barrier ribs defining discharge cells; and discharge sustain electrodes on a surface of the second substrate opposing the first substrate, the discharge sustain electrodes being substantially perpendicular to the address electrodes, wherein the electrodes are in groups of electrodes, and the electrodes further comprise:

effective segment elements in the display region, terminal segment elements in a terminal region located outside the display region and having a pitch smaller than a pitch between the effective segment elements, and intermediate segment elements interconnecting the effective segment elements and the terminal segment elements, and wherein at least one group is configured such that lengths of the terminal segment elements increasingly decrease as a distance from a center of the at least one group is increased.

2. The plasma display panel of claim 1, wherein the terminal segment elements are selectively reduced in length.

3. The plasma display panel of claim 1, wherein the intermediate segment elements are curved in a direction away from the center of the corresponding group.

4. The plasma display panel of claim 3, wherein the intermediate segment elements have an increasingly decreasing curvature as a distance to the center of the corresponding group is reduced.

5. The plasma display panel of claim 1, wherein the intermediate segment elements are in the terminal region, and at least one of the intermediate segment elements of each electrode group has a bend in the terminal region.

6. The plasma display panel of claim 5, wherein each of the intermediate segment elements has at least two linear sections, and the bend of the intermediate segment elements is arc-shaped.

7. The plasma display panel of claim 6, wherein an angle of 90 degrees or greater is formed between the linear sections.

8. The plasma display panel of claim 7, wherein the intermediate segment elements include first linear sections formed connected to the effective segment elements without undergoing any additional bending and change in curvature, and second linear sections extended from the bends to be connected to the terminal segment elements without undergoing any additional bending and change in curvature, the first linear sections and the second linear sections having a length that decreases as the centers of the electrode groups are approached.

9. The plasma display panel of claim 5, wherein the intermediate segment elements include first linear sections, second linear sections, and third linear sections interconnected such that the first linear sections and the third linear sections are interconnected at obtuse angles, the second linear sections and the third linear sections are interconnected at obtuse angles formed, and the bend of the elements is arc-shaped.

10. The plasma display panel of claim 9, wherein the first linear sections are formed connected to the effective segment elements without undergoing any additional bending and change in curvature, the third linear sections are extended at a predetermined angle to the first linear sections, and the second linear sections are extended at a predetermined angle to the third linear sections, and the first linear sections, second linear sections, and third linear sections have a length that decreases as the centers of the electrode groups are approached.

11. The plasma display panel of claim 1, wherein in each of the electrode groups, a straight line may be drawn through points where the intermediate segment elements meet the terminal segment elements.

12. The plasma display panel of claim 1, wherein in each of the electrode groups, a curved line may be drawn through points where the intermediate segment elements meet the terminal segment elements.

13. An interconnection circuit for interconnecting electrodes to input terminals comprising:

a group of first segment elements interfacing with respective electrodes, the group of first segment elements having an output pitch between each of the first segment elements; and a group of second segment elements interfacing with respective input terminals, the group of second segment elements having an input pitch between each of the second segment elements, the input pitch being smaller than the output pitch, wherein lengths of the second segment elements increasingly decrease as a distance from a center of the group of second segment elements is increased.

14. The interconnection circuit of claim 13, wherein the second segment elements are selectively reduced in length.

15. The interconnection circuit of claim 13, wherein the first segment elements are curved in a direction away from the center.

16. The interconnection circuit of claim 15, wherein the first segment elements have an increasingly decreasing curvature as a distance to the center is reduced.

17. The interconnection circuit of claim 13, wherein the first segment elements each have at least two linear sections.

18. The interconnection circuit of claim 17, wherein an angle of 90 degrees or greater is formed between the at least two linear sections.

19. A plasma display panel, comprising:

a first substrate and a second substrate opposing one another with a gap therebetween;

address electrodes on a surface of the first substrate opposing the second substrate;

barrier ribs in a display region between the first substrate and the second substrate, the barrier ribs defining discharge cells; and discharge sustain electrodes on a surface of the second substrate opposing the first substrate, the discharge sustain electrodes being substantially perpendicular to the address electrodes, wherein the electrodes are in groups of electrodes, and the electrodes further comprise:

effective segment elements in the display region, terminal segment elements in a terminal region located outside the display region and having a pitch that is smaller than a pitch between the effective segment elements, and intermediate segment elements directly interconnecting the effective segment elements and the terminal segment elements, and wherein at least one group is configured such that lengths of the terminal segment elements increasingly decrease as a distance from a center of the at least one group is increased.

20. An interconnection circuit for interconnecting electrodes to input terminals comprising:

a group of first segment elements directly interfacing with respective electrodes, the group of first segment elements having an output pitch between each of the first segment elements; and a group of second segment elements directly interfacing with respective input terminals and with respective electrodes of the group of first segment elements, the group of second segment elements having an input pitch between each of the second segment elements, the input pitch being smaller than the output pitch, wherein lengths of the second segment elements increasingly decrease as a distance from a center of the group of second segment elements is increased.

* * * * *